US005119597A

United States Patent [19]

Davidson

[11] Patent Number: 5,119,597

[45] Date of Patent: Jun. 9, 1992

[54] CENTRIFUGAL DISK FINISHING APPARATUS

[75] Inventor: Richard S. Davidson, Sturgis, Mich.

[73] Assignee: The Grav-I-Flo Corporation, Sturgis, Mich.

[21] Appl. No.: 574,211

[22] Filed: Aug. 28, 1990

[51] Int. Cl.[5] ..... B24B 31/02

[52] U.S. Cl. ..... 51/163.1; 51/164.1

[58] Field of Search ..... 51/163.1, 163.2, 164.1, 51/313; 241/175, 30

[56] References Cited

U.S. PATENT DOCUMENTS

| | | | |
|---|---|---|---|
| 4,096,666 | 6/1978 | Brown | 51/164.1 X |
| 4,177,608 | 12/1979 | Balz | 51/163.2 |
| 4,850,151 | 7/1989 | Ditscherlein | 51/163.2 |
| 4,884,372 | 12/1989 | McNeil | 51/163.2 |
| 4,958,776 | 9/1990 | Walther | 51/163.2 X |

FOREIGN PATENT DOCUMENTS

| | | | |
|---|---|---|---|
| 58-59762 | 4/1983 | Japan | 51/164.1 |
| 580099 | 11/1977 | U.S.S.R. | 51/163.2 |

OTHER PUBLICATIONS (English translation) Iwase, Japanese Patent Application Disclosure 58-59762, Apr. 8, 1983.

Copy of U.S. Pat. 4,884,372, FIG. 2, McNeil Dec. 5, 1989 filed Oct. 6, 1987 .

*Primary Examiner*—M. Rachuba

*Attorney, Agent, or Firm*—Barnes, Kisselle, Raisch, Choate, Whittemore & Hulbert

[57] ABSTRACT

A centrifugal disk finishing apparatus comprising a finishing chamber including an upstanding wall and a rotatable disk forming the bottom wall of the chamber. The disk is mounted in such a manner that a precision gap, known as a seal, is provided between the lower edge of the upstanding wall and the periphery of the disk. The seal extends upwardly and inwardly from the periphery of the disk. The construction of the wall and the support of the wall and disk is such that the disk and wall are rigidly maintained in concentric relation in all conditions of operation and load and therefore the liquid utilized in the finishing apparatus can flow readily through the seal during operation of the apparatus.

45 Claims, 5 Drawing Sheets

CENTRIFUGAL DISK FINISHING APPARATUS

This invention relates to centrifugal disk finishing apparatus.

BACKGROUND AND SUMMARY OF THE INVENTION

It has been known to deburr and finish parts by machines known as disk finishing machines. Typical machines are shown, for example, in U.S. Pat. Nos. 4,096,666, 4,177,608, Japanese Patent 4,636,137 (1968), United Kingdom Patent 1,166,864, and USSR Patents 452,481 (1974), 058099 (1977), and 0,942,960 (1982).

In such systems, media (plastics, ceramics, etc.) and parts to be finished are contained in a finishing chamber, comprised of a rotating disk or rotor and a stationary, upstanding sidewall. As the disk or rotor rotates, centrifugal force exerts pressure on the combined media and parts on the stationary sidewall, where gravity stalls the mass and the mass falls toward the center of the rotor or disk. The continuing rotation of the rotor or disk provides a continuous cascading action of the mass toward center, as well as advance of the mass about the perimeter f the finishing chamber.

The action of such machines is a combination of the common tumbling barrel, which relies completely on the "fall" of the mass for its resulting work on parts, and the "scrubbing action" of common vibratory finishing, which features a mass of parts and media in continuous motion. The centrifugal force also accelerates the action in the finishing chamber, thereby reducing the time cycle required to finish the parts.

By using media containing many different abrasives, various finishes, from heavy deburring and material removal to very fine surface improvement, may be achieved.

The present invention is directed primarily to a "wet" process, where water is combined with a chemical detergent to clean the mass, suspend soils, and provide some lubricity to the parts and media.

A common problem of centrifugal disk finishing machines is that the rotor or disk is not supported well enough to maintain integrity at the joint or seal where the rotating disk and stationary sidewall meet.

As a result, there is a tendency for the disk to move laterally relative to the upstanding wall of the drum causing the rotor and wall to interfere with the narrow passage formed between the periphery of the rotor and wall through which the liquid normally passes, known as a seal. This causes contact and wear of the seal and interferes with the flow of liquid.

Accordingly, among the objectives of the present invention are to provide a method and apparatus for finishing parts wherein the rotor and wall are rigidly maintained in concentric relation under all conditions of operation and load; which incorporates a novel seal; wherein incorporates removable rings at the juncture of the seal; and which is easy to maintain.

In accordance with the invention, the centrifugal disk finishing apparatus embodying the invention comprises a finishing chamber including an upstanding wall and a rotatable disk forming the bottom wall of the chamber. The disk is mounted in such a manner that a precision gap, known as a seal, is provided between the lower edge of the upstanding wall and the periphery of the disk. The construction of the wall and the support of the wall and disk is such that the disk and wall are rigidly maintained in concentric relation in all conditions of operation and load and therefore the liquid utilized in the finishing apparatus can flow readily through the seal during operation of the apparatus.

DESCRIPTION OF THE PREFERRED EMBODIMENTS

Figure 1:
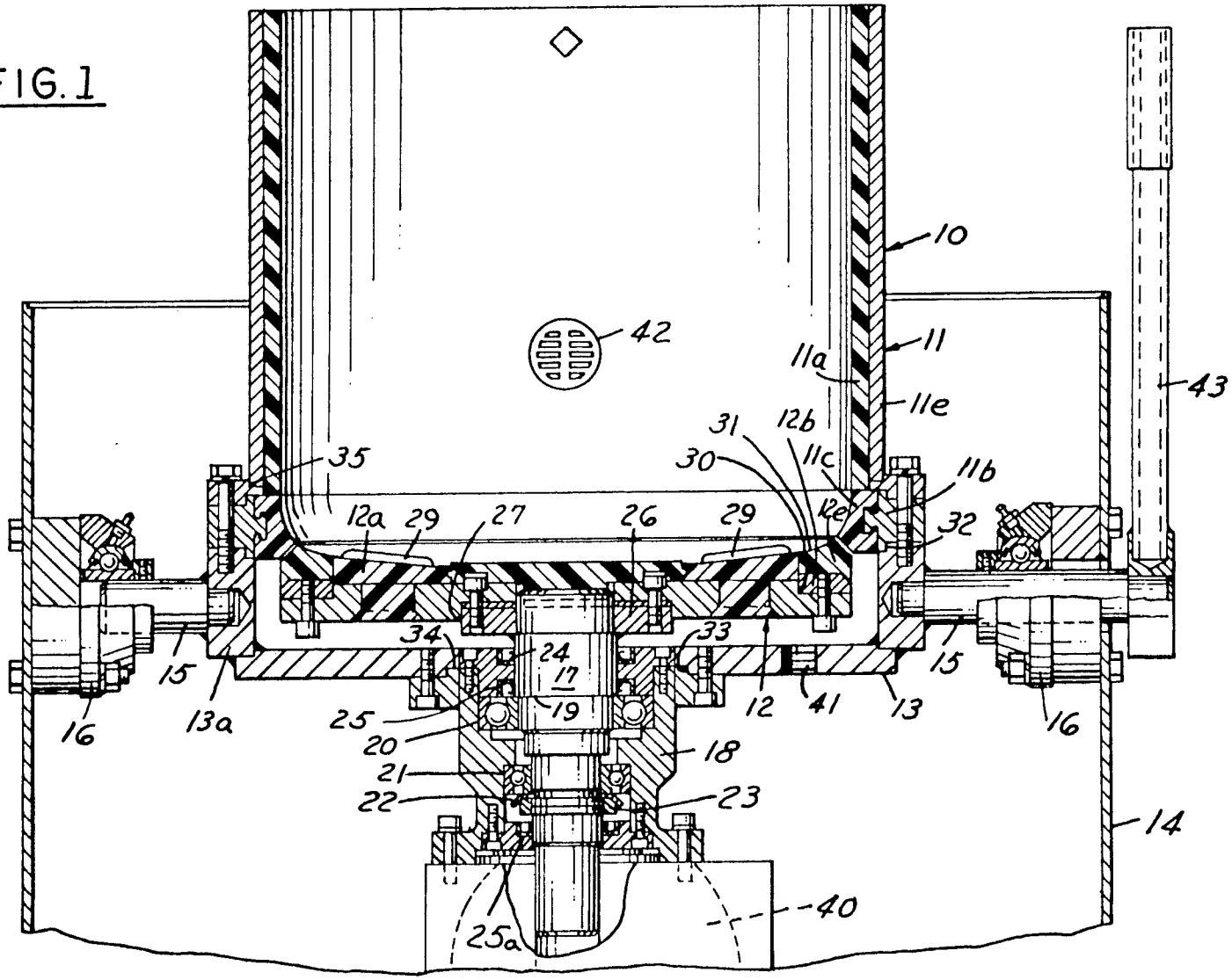
FIG. 1 is a vertical sectional view of a apparatus embodying the invention.
Figure 2:
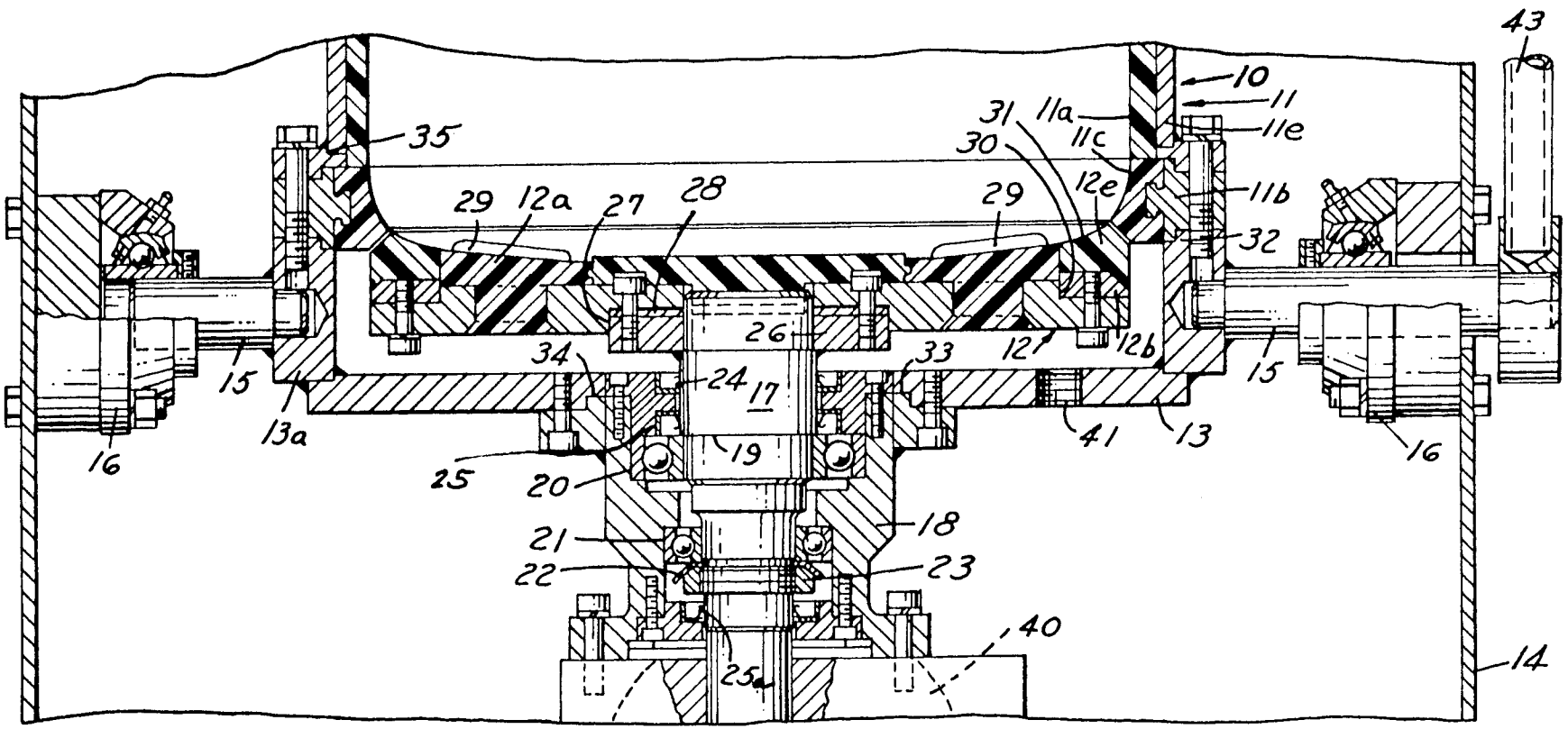
FIG. 2 is a fragmentary sectional view on an enlarged scale of the portion of the apparatus shown in FIG. 1.

Referring to FIG. 1, in accordance with the invention, the centrifugal disk finishing apparatus embodying the invention comprises a finishing chamber or tub 10 formed by a upstanding wall 11 and a concentric rotatable rotor or disk 12 which are supported, as presently described, on a tiltable base 13 which, in turn, is mounted tilting about a horizontal axis on a frame 14 by aligned horizontal shafts 15 extending into flange bearings 16.

In accordance with the invention, a precision disk 12 rigidly supported on a spindle or shaft 17 which rotates concentrically about its axis in a rigid tubular column or turntable 18 bolted on the underside of the base 13 such that the spindle is not allowed to deflect relative to the axis of turntable 18. The spindle 17 has a shoulder 19 which rests on a thrust ball bearing 20 to support the load of the disk 12 as well as the parts and media in the finishing chamber 10. A second thrust ball bearing 21 is mounted opposite the first bearing and a lockwasher 22 and locknut 23 threaded on spindle 17 are employed to retain the spindle so that no lateral motion may occur relative to the axis. Seals 24, 25, **25*a* are mounted so that the upper seal 24 prevents water from penetrating the base 13 and the intermediate seal 25 retains grease in the bearing cavity and prevents it from penetrating the water cavity above. Seal 25*a*** prevents grease from escaping down the shaft.

The spindle assembly utilizes precise machining methods for maintaining concentricity, i.e., bearing journals and bearing cavities are held in a lathe chuck while the mating surfaces, which are piloted, are machined.

A flange 26 is welded to the spindle 17 and locates the rotating disk 12 on the turntable. Concentricity of the disk 12 is held by machining the flange pilot cavity 27 on disk 12 first, then holding in the flange pilot cavity 27 in a lathe chuck and utilized this machined cavity 27 to machine all other surfaces of the disk 12.

A shim 28 is provided between the flange 26 and rotor 12 is ground at assembly to the exact dimension required to maintain a gap between the rotor 12 and the stationary sidewall 11. A series of bolts retains the rotor on the flange 26 on spindle 17.

The disk 12 must be comprised of a stock thickness and/or reinforced through various configurations to prevent any distortion or flexibility, especially at the outer periphery, to prevent deflection during operation.

Bonded to the disk 12 is a polyurethane elastomer layer 12*a* which is shaped to the desired contour in a mold. Circumferentially spaced radial cleats or ribs 29 are molded in the polyurethane to give the disk 12 better contact with the media and parts. The number of ribs 29 depends upon the configuration of the molded disk 12, the capacity of the finishing chamber and the speed at which the disk rotates.

The disk or rotor features a unique, removable wear ring 12*b* about its periphery, allowing this high elastomeric wear element 12*e* thereon to be replaced rather than to replace the entire disk. A higher rate of wear exists farther away from the central axis. Employing a removable wear ring 12*b* will greatly extend the useful life of the center portion of the disk and reduce the cost of replacement substantially.

The disk 12 has a pilot diameter 30 concentric with the spindle flange 27 pilot to locate the disk wear ring 12*b* concentric with the central axis.

The disk wear ring 12*b* is unique in that it has an upper surface 31 with a radius of 45° leading up to a 45° joint angle which drops away from the joint or seal molded within the polyurethane lining 12*e*. A mating tub outer wear ring 11*b* on the stationary wall 11 and 11*b* has an upper surface with a radius of 45° descending to a 45° joint angle molded in polyurethane layer 11*c*. The disk wear ring 12*e* and the tub outer wear ring 11*b* together make up the joint between the rotating and stationary surfaces. The reason for the resulting 90° continuous radius is to smoothly channel the flow of media and parts upwardly over the joint, and to prevent any intrusion of media, parts, abrasive of fines in the joint from the pressure of the process.

The preferred form is to have a non-contact joint or seal with no possibility of the rotating surface contacting the stationary surface. A gap of 0.020 inch is preferred however, the gap may range between 0.002 inch to 0.060 inch. The tub outer wear ring 11*b* must be machined concentric for non-contact to be successful. Pilot diameters are machined concentric to accomplish this.

Figure 3:
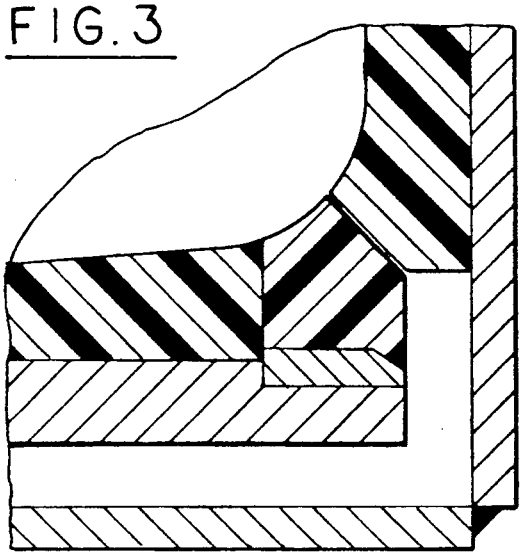
FIG. 3 is a partly diagrammatic sectional view of a portion of the apparatus.
Figure 4:
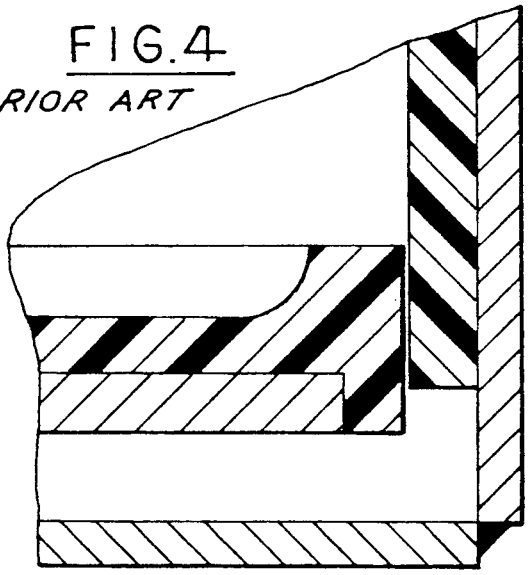
FIG. 4 PRIOR ART
FIGS. 4 and 5 are partly diagrammatic views of portions of prior art apparatus.
Figure 5:
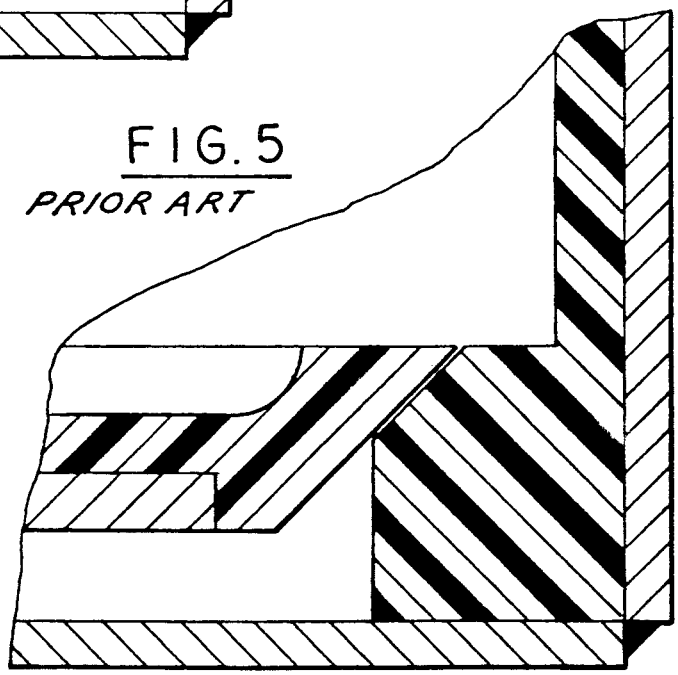
FIG. 5 PRIOR ART

Referring to the schematic views, FIGS. 3-5, since the joint or seal extends upwardly and inwardly as molded (FIG. 3), there is no possibility of any contact at the joint in the event of the rotor deflecting downward due to weight of the media and parts, as in other designs which have vertical joints or seals or joints wherein the gap extends upwardly and outwardly (FIGS. 4,5) and held within the same gap tolerance.

The base wall 13*a*, on which the tub outer wear ring 11*b* located on the tub, again contains machined surfaces 32 held concentric. The center pilot 33, where the column 18 locates is machined concentric to the pilot 32 where the tub outer wear ring locates, to insure that the disk wear ring 12*b* is rotating concentrically within the tub outer wear ring 11*b*. Also, the surface 34 on which the turntable 18 is bolted is held parallel to the surface on which the tub outer wear ring 11*b* is bolted. This is accomplished by facing off these mating surfaces while the piece is in the lathe chuck, after turning pilots for concentricity.

Upper wall 11*e* tub is located concentrically with a pilot on the tub outer wear ring 11*b*. This is the surface where the mass of parts and media loses momentum and cascades toward the center of the tub. This portion of the tub is lined with a polyurethane lining 11*a* to prevent wear and the inside surface may or may not have ribs or ridges molded into it. The reason for ribs is to keep light, flat parts from sticking to the tub wall and then being carried about the tub diameter, rather tan being forced back down into the cascading mass.

The turntable assembly is powered by a hollow shaft gearmotor 40 mounted on the column 18, where the spindle shaft extends below the lower flange of the turntable. This allows for a compact design. It is important in this instance that the spindle shaft tolerance to the gearbox hollow shaft tolerance be held close to maintain concentricity. A cavity in the bottom of the turntable assembly allows sufficient clearance so that the pilot diameter on the gearbox does not make contact with the turntable assembly. This eliminates the need to hold concentricity in two places for the same location.

Figure 6:
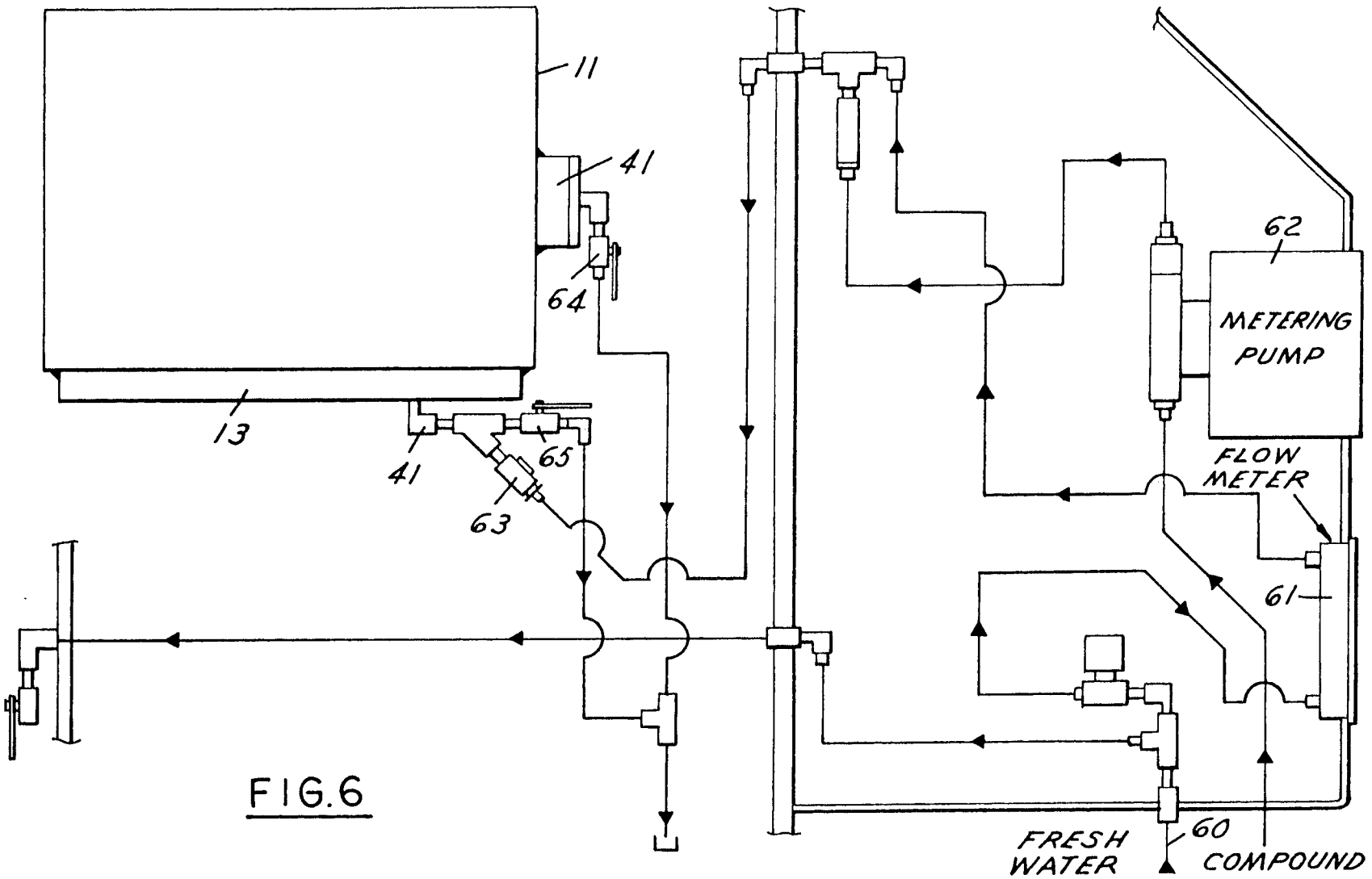
FIG. 6 is a schematic of the flow of liquid in the apparatus.

An important element of the finishing of parts in a centrifugal disk finisher is a continuous flow of water and compound within the finishing mass. Referring to FIG. 6, a flow-through system comprises a water source 60 which supplies water to a manually adjusted water flow meter 61 (0-50 gallons per hour), and a metering pump 62 which injects a chemical compound in a ratio of ounces of chemical compound per gallon of water.

This mixture, of compound and water flows into the apparatus base 13 through a check valve 63 which contains a small open cavity 41 and subsequently flows up through the gap of the non-contact joint or seal. The minimum flow rate is preferably ten gallons per hour. A benefit of the aqueous solution being introduced from the cavity below the joint is the prevention of the intrusion of parts, media or media fines from the joint.

A continuous "flow-through" system also ensures that the heat, generated by aggressive media in heavy deburring processes,. is controlled by the introduction of fresh, cool water and compound.

The water and compound solution is carried, along with the mass of parts and media due to the centrifugal force, onto the stationary sidewall, then cascades toward center as well as advancing about the perimeter of stationary finishing tub 10. Drain 42 in the side wall of the stationary tub, much like that of a conventional vibratory machine, allows a similar continuous draining of effluent and media fines from the finishing chamber. It is preferred that the sidewall drain 42 be positioned one to two inches below the operating height of the mass of media and parts. This provides optimum finishing results. An adjustable valve 64 can be placed in the drain line to regulate the amount of liquid allowed to remain in the finishing mass, with better deburring being achieved with a lower water level and finer finishes achieved with higher levels. If too much water is allowed to remain in the tub, the mass of media and parts will tend to "float", with a result of very little work being accomplished.

In prior machines which rely on flowing out a center-shaft drain for "in process" draining, too much water is accumulated in the finishing chamber, with a resulting "floating" mass and a restrictive process where an operator must monitor the liquid level at regular intervals, to eliminate excess water and compound.

When the finishing cycle is complete, the machine rotation stops and flow-through water and chemical compound injection stops. A drain through passage 41 in the bottom chamber of the base 13 is opened by valve 65 either manually or automatically to discharge the solution from the cavity. Any remaining solution above the disk drains through the joint.

The tub 10 is mounted on the pivots which allows the unit to be tilted by a handle 43 for discharge of the media and parts, either manually or automatically, over a separation unit, either manual or automatic, or into a tote pan for separation elsewhere, or onto a conveyor. The apparatus is then ready to be returned to the running position and a new charge of parts and media may be started.

An electronic variable speed controller is preferably used and has important advantages in its use in centrifugal disk finishing. It makes little difference whether the joint or seal touches or allows a running clearance; the possibility of media fines, burrs, or other contaminants is a high probability. The electronic variable speed drives ramp up slowly to operating speed at a desired rate allowing any contaminants to be flushed out of the joint or seal during the "start-up" as opposed to the "instant-on" of a motor starter contactor. For example, the controller can be set at 5 seconds. The controller is also capable of being set to operate at various speeds. Such a controller is sold by Yaskawa Electric, Model No. CIMR-G22AS$_2$. A prime example would be a finisher with an out-of-concentricity problem. Particles, in an "instant-on" situation, could be embedded in the joint or seal as the contaminant is drawn from the large clearance lobe to the tight clearance lobe of the rotation. Once contaminants are allowed to be embedded in the joint or seal, they can destroy the polyurethane elastomer by either aggression or build-up of heat.

Molds are used to develop the interior of the finishing chamber, with emphasis on the joint between the rotating disk or rotor and stationary sidewall and maintaining the integrity of concentricity. All of the molds used to make the disk 12, disk wear ring 12*b*, tub outer wear ring 11*b* and upper tub 11*a* employ the use of pilots machined concentric with the mating pieces of each mold. Also, the inserts for the disk, disk wear ring, tub outer wear ring and upper tub are machined concentric and locate within the machined pilots in the molds. Allowance for shrinkage of the polyurethane must also be calculated into the machining of the molds so that once the parts are finish molded, there is no need to alter them in a further machining operation. The parts in other words are used "as cast".

After consideration of all of the above, a dry process variation is applicable. A dry media, composed commonly as ground corn cobs, wood sawdust, wood shapes (such as cubes, trapezoids, shoe pegs), walnut shells and other similar products which would then be combined with an abrasive and then with or without some sort of lubricant (grease, wax, etc.), can be used to finish parts in a centrifugal disk apparatus. In such a use, the water can be replaced by air.

Compressed air is not desirable. Compressed air contains too much moisture for a successful dry process. Positive, low-pressure air is preferred. This can be used to obviously prevent intrusion of media particles from the joint or seal.

In such an apparatus which does not use liquid, ground corn cob is mixed with an abrasive, suitable for the desired finish to be achieved, and then coated with a tallow and wax mixture to retain the abrasive on the particle of cob meal. When this material is used in high energy equipment such as spindle type, centrifugal barrel, or disk finishing equipment, heat is generated very quickly due to the rapid amount of work being accomplished. If the media is allowed to reach temperatures exceeding 200° F., the structure of the lubricants containing the abrasives onto the carrier (cob meal, wood, etc.) will deteriorate, resulting in the premature failure of the media.

As set forth in U.S. Pat. No. 2,899,777, incorporated herein by reference, the operating parameters as well as the composition of the media are presented for high energy spindle finishing. The media, under this patent, is cooled by water jacket only. Further developments on the patent have shown that introducing positive, low-pressure air, through the media, would contribute toward the effective cooling under production conditions. Merely blowing air "on top" of the media is very ineffective.

Figure 7:
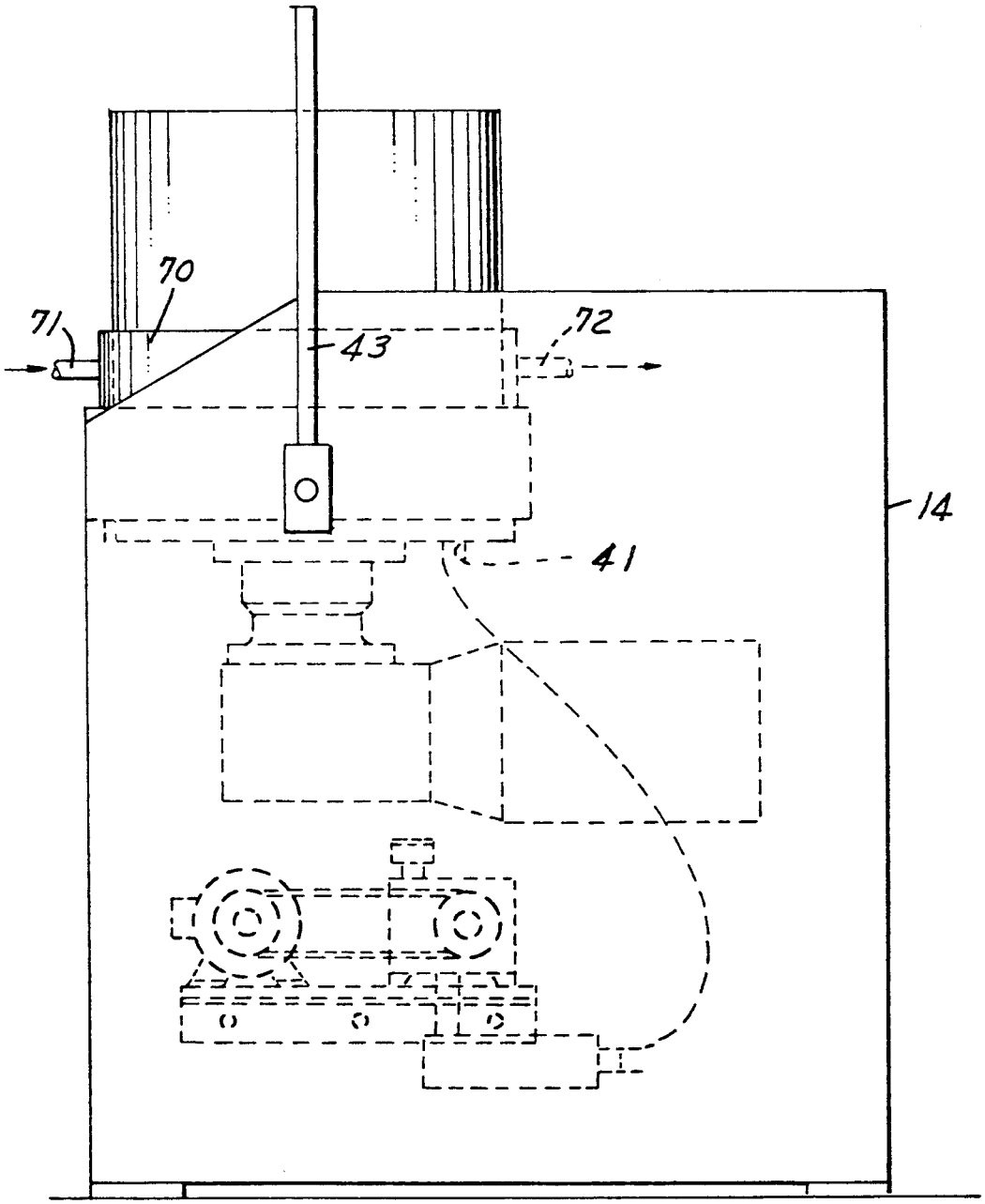
FIG. 7 is a schematic of a modified form of apparatus.

In order to utilize air in the centrifugal disk finisher of the present invention, as shown schematically in FIG. 7, a modification is made to eliminate the flow-through water system and drain, and to use positive, low-pressure air introduced through opening 41 and passing through the joint or seal formed by ring 11*c* and ring 12*c*. Since the working mass parts and dry media are continually passing over the joint, the air is capable of sufficiently cooling and maintaining the compound under production conditions.

A further modification to the centrifugal disk finisher provides for additional cooling dry process media. In this form, the entire disk, disk wear ring, tub outer wear ring and upper tub are made completely from steel and a water jacket 70 is provided on the outside of the machine tub through which water is circulated through an inlet 71 as shown schematically and an outlet 72 . This would be in addition to the air cooling through the joint.

The following features are of importance in the apparatus:

(a) a joint or seal at a 45° angle extending inwardly and upwardly;

(b) absolute non-contact joint;

(c) method for maintaining concentricity in operation;

(d) method for maintaining concentricity of the molded parts;

(e) removable wear ring on rotating disk;

(f) removable wear ring on stationary tub;

(g) fully supported disk by turntable;

(h) disk of sufficient thickness so as not to deflect;

(i) rotating axis must remain perpendicular to the running plane of the joint or seal;

(j) electronic variable speed;

(k) liquid or dry process media;

(l) flow-through liquid flow with preferred outer wall drain, one to two inches below running mass level.

I claim:

1. A centrifugal disk finishing apparatus comprising a finishing chamber, said finishing chamber comprising a stationary upstanding wall and a rotatable disk associated with the upstanding wall, a base defining a fluid chamber beneath said disk, said upstanding wall having a lower edge defining an annular smooth accurately formed surface that extends upwardly and radially inwardly at an angle of about 45° to the axis of the finishing chamber, said disk having a peripheral edge having an annular accurately formed surface extending upwardly and radially inwardly at an angle of about 45° to the axis of the finishing chamber, said annular surfaces defining a uniform gap comprising a non-contact seal for fluid flow from said fluid chamber upwardly and inwardly into said finishing chamber, said disk being constructed such that it is rigid so that the uniformity of the gap is maintained during rotation of the disk, said lower edge of said stationary wall having a curved annular upper surface having a radius of about 45° intersecting the annular surface on the lower edge of the upstanding wall, said curved surface on said wall merging smoothly with the adjacent portion of the internal surface of the adjacent portion of said upstanding wall, said peripheral edge of said disk having a curved upper surface having a radius of about 45° intersecting the annular surface on the peripheral edge thereof, said curved surface on said disk merging smoothly with the adjacent surface of said disk, said disk having a transverse inner surface merging with said curved surface on the peripheral edge of said disk, said curved surface on said peripheral wall and said curved surface on said disk forming a continuous surface having a radius of about 90° intersected by said gap at an angle of about 45° to the axis of the finishing chamber such that fluid may flow upwardly through the gap to prevent parts, abrasive fluids and the like from passage downwardly through the gap, means for mounting said upstanding wall and said disk such that the gap is maintained uniform both when the apparatus is operating and when the apparatus is not operating, means for providing fluid to said fluid chamber such that fluid flows continuously from said fluid chamber upwardly through said gap into said finishing chamber.

2. The centrifugal disk finishing apparatus set forth in claim 1 wherein said annular surface and said curved surface on said stationary wall are formed on a removable wall ring on the upstanding wall, and means for mounting said removable wall ring on said upstanding wall comprising first cooperating peripheral surfaces formed on said wall ring and said wall for holding said wall ring concentric with said wall and second cooperating axial surfaces formed on said fluid chamber for holding said ring concentric with said chamber, and cooperating radial surfaces formed on said wall ring and said wall for locating said wall ring axially on said wall.

3. The centrifugal disk finishing apparatus set forth in claim 1 wherein said annular surface and said curved surface on said stationary wall are formed on a removable disk ring, and means for mounting said disk ring on said disk comprising peripheral cooperating surfaces formed on said disk ring and said disk for holding said disk ring concentric with said disk and cooperating radial surfaces formed on said disk ring and said disk for locating said disk ring axially on said disk.

4. The centrifugal disk finishing apparatus set forth in claim 1 wherein said means for mounting said upstanding wall and said disk such that the gap is maintained uniform both when the apparatus is operating and when the apparatus is not operating includes a spindle, means for locating said disk on said spindle comprising cooperating axial surfaces formed on said disk and spindle for holding said disk concentric with said spindle, means rotatably mounting said spindle comprising a turntable, means for locating said spindle on said turntable comprising peripheral surfaces formed on said spindle and said turntable for locating said spindle concentric in said turntable and radial surfaces formed on said spindle and said turntable for locating said spindle axially on said turntable, means for mounting said turntable on said fluid chamber such that the spindle extends into said fluid chamber including cooperating peripheral surfaces formed on said turntable and said fluid chamber for locating the spindle concentric with said fluid chamber, cooperating radial surfaces formed on said turntable and said chamber for locating said turntable axially on said fluid chamber.

5. The centrifugal disk finishing apparatus set forth in claim 1 wherein said annular surface and said curved surface on said stationary wall are formed on a removable wall ring on the upstanding wall, and means for mounting said removable wall ring on said upstanding wall comprising first cooperating peripheral surfaces formed on said wall ring and said wall for holding said wall ring concentric with said wall and second cooperating axial surfaces formed on said fluid chamber for holding said ring concentric with said chamber, and cooperating radial surfaces formed on said wall ring and said wall for locating said wall ring axially on said wall, said annular surface and said curved surface on said disk being formed on a removable disk ring, and means for mounting said disk ring on said disk comprising peripheral cooperating surfaces formed on said disk ring and said disk for holding said disk ring concentric with said disk and cooperating radial surfaces formed on said disk ring and said disk for locating said disk ring axially on said disk, said means for mounting said upstanding wall and said disk such that the gap is maintained uniform both when the apparatus is operating and when the apparatus is not operating includes a spindle, means for locating said disk on said spindle comprising cooperating axial surfaces formed on said disk and spindle for holding said disk concentric with said spindle, means rotatably mounting said spindle comprising a turntable, means for locating said spindle on said turntable comprising peripheral surfaces formed on said spindle and said turntable for locating said spindle concentric in said turntable and radial surfaces formed on said spindle and said turntable for locating said spindle axially on said turntable, means for mounting and turntable on said fluid chamber such that the spindle extends into said fluid chamber including cooperating peripheral surfaces formed on said turntable and said fluid chamber for locating the spindle concentric with said fluid chamber, cooperating radial surfaces formed on said turntable and said chamber for locating said turntable axially on said fluid chamber.

6. The centrifugal disk finishing apparatus set forth in claim 1 including an elastomeric layer on at least the annular surfaces and curved surfaces of said upstanding wall and said disk.

7. The centrifugal disk finishing apparatus set forth in claim 6 wherein said elastomeric layer is molded to provide an accurate annular surface on said wall and disk.

8. The centrifugal disk finishing apparatus set forth in claim 7 wherein said annular surface and said curved surface on said stationary wall are formed on a removable wall ring on the upstanding wall, and means for mounting said removable wall ring on said upstanding wall comprising first cooperating peripheral surfaces formed on said wall ring and said wall for holding said wall ring concentric with said wall and second cooperating peripheral surfaces formed on said fluid chamber for holding said ring concentric with said chamber, and cooperating radial surfaces formed on said wall ring and said wall for locating said wall ring axially on said wall, said annular surface and said curved surface on said disk are formed on a removable disk ring, and means for mounting said disk ring on said disk comprising peripheral cooperating surfaces formed on said disk ring and said disk for holding said disk ring concentric with said disk and cooperating radial surfaces formed on said disk ring and said disk for locating said disk ring axially on said disk, each said ring comprising an elastomeric portion molded on a metal portion, said metal portion having said axial and radial surfaces thereon.

9. The centrifugal disk finishing apparatus set forth in claim 5 wherein an elastomeric coating is provided on substantially the entire inner surface of said upstanding wall and substantially the entire inner surface of the disk.

10. The centrifugal disk finishing apparatus set forth in claim 9 wherein said means for providing fluid to said fluid chamber comprises a source of liquid under pressure, said upstanding wall having a liquid outlet adjacent the upper edge thereof, said outlet being positioned below the operating height of the media and parts.

11. The centrifugal disk finishing apparatus set forth in claim 10 including a control circuit for supplying liquid from said source of liquid under pressure comprising a check valve and an off-on valve for draining the fluid chamber.

12. The centrifugal disk finishing apparatus set forth in claim 1 wherein said means for providing fluid to said chamber comprises means for supplying positive low pressure air to said fluid chamber such that the air cools the gap.

13. A centrifugal disk finishing apparatus comprising a finishing chamber, said finishing chamber comprising a stationary upstanding wall and a rotatable disk associated with the upstanding wall, a base defining a fluid chamber beneath said disk, said upstanding wall having a lower edge defining an annular smooth accurately formed surface, said disk having a peripheral edge having an annular accurately formed surface, said annular surfaces defining a uniform gap comprising a non-contact seal for fluid flow from said fluid chamber into said finishing chamber, said disk being constructed that it is rigid such that the uniformity of the gap is maintained during rotation of the disk, said lower edge of said stationary wall having a curved annular upper surface intersecting the annular surface on the lower edge of the upstanding wall, said curved surface on said wall merging smoothly with the adjacent portion of the internal surface of the adjacent portion of said upstanding wall, said peripheral edge of said disk having a curved upper surface intersecting the annular surface on the peripheral edge thereof, said curved surface on said disk merging smoothly with the adjacent surface of said disk, said disk having a transverse inner surface merging with said curved surface on the peripheral edge of said disk, said curved surface on said peripheral wall and said curved surface on said disk forming a continuous surface intersected by said gap such that fluid may flow upwardly through the gap to prevent parts, abrasive fluids and the like from passage downwardly through the gap, means for mounting said upstanding wall and said disk such that the gap is maintained uniform both when the apparatus is operating and when the apparatus is not operating, means for providing fluid to said fluid chamber such that fluid flows continuously from said fluid chamber through said gap into said finishing chamber, said annular surface and said curved surface on said stationary wall being formed on a removable wall ring on the upstanding wall, and means for mounting said removable wall ring on said upstanding wall comprising first cooperating peripheral surfaces formed on said wall ring and said wall for holding said wall ring concentric with said wall and second cooperating peripheral surfaces formed on said fluid chamber for holding said ring concentric with said chamber, and cooperating radial surfaces formed on said wall ring and said wall for locating said wall ring axially on said wall.

14. The centrifugal disk finishing apparatus set forth in claim 13 wherein said annular surface and said curved surface on said disk are formed on a removable disk ring, and means for mounting said disk ring on said disk comprising peripheral cooperating surfaces formed on said disk ring and said disk for holding said disk ring concentric with said disk and cooperating radial surfaces formed on said disk ring and said disk for locating said disk ring axially on said disk.

15. The centrifugal disk finishing apparatus set forth in claim 13 wherein said means for mounting said upstanding wall and said disk such that the gap is maintained uniform both when the apparatus is operating and when the apparatus is not operating includes a spindle, means for locating said disk on said spindle comprising cooperating peripheral surfaces formed on said disk and spindle for holding said disk concentric with said spindle, means rotatably mounting said spindle comprising a turntable, means for locating said spindle on said turntable comprising peripheral surfaces formed on said spindle and said turntable for locating said spindle concentric in said turntable and radial surfaces formed on said spindle and said turntable for locating said spindle axially on said turntable, means for mounting said turntable on said fluid chamber such that the spindle extends into said fluid chamber including cooperating peripheral surfaces formed on said turntable and said fluid chamber for locating the spindle concentric with said fluid chamber, cooperating radial surfaces formed on said turntable and said chamber for locating said turntable axially on said fluid chamber.

16. The centrifugal disk finishing apparatus set forth in claim 13 wherein said annular surface and said curved surface on said stationary wall are formed on a removable wall ring on the upstanding wall, and means for mounting said removable wall ring on said upstanding wall comprising first cooperating peripheral surfaces formed on said wall ring and said wall for holding said wall ring concentric with said wall and second cooperating peripheral surfaces formed on said fluid chamber for holding said ring concentric with said chamber, and cooperating radial surfaces formed on said wall ring and said wall for locating said wall ring axially on said wall, said annular surface and said curved surface on said disk are formed on a removable disk ring, and means for mounting said disk ring on said disk comprising peripheral cooperating surfaces formed on said disk ring and said disk for holding said disk ring concentric with said disk and cooperating radial surfaces formed on said disk ring and said disk for locating said disk ring axially on said disk, said means for mounting said upstanding wall and said disk such that the gap is maintained uniform both when the apparatus is operating and when the apparatus is not operating includes a spindle, means for locating said disk on said spindle comprising cooperating peripheral surfaces formed on said disk and spindle for holding said disk concentric with said spindle, means rotatably mounting said spindle comprising a turntable, means for locating said spindle on said turntable comprising peripheral surfaces formed on said spindle and said turntable for locating said spindle concentric in said turntable and radial surfaces formed on said spindle and said turntable for locating said spindle axially on said turntable, means for mounting said turntable on said fluid chamber such that the spindle extends into said fluid chamber including cooperating peripheral surfaces formed on said turntable and said fluid chamber for locating the spindle concentric with said fluid chamber, cooperating radial surfaces formed on said turntable and said chamber for locating said turntable axially on said fluid chamber.

17. The centrifugal disk finishing apparatus set forth in claim 12 including elastomeric layer on at least the annular surfaces and curved surfaces on said upstanding wall and said disk.

18. The centrifugal disk finishing apparatus set forth in claim 17 wherein said elastomeric layer is molded to provide an accurate annular surface on said wall and disk.

19. The centrifugal disk finishing apparatus set forth in claim 18 wherein said annular surface and said curved surface on said stationary wall are formed on a removable wall ring on the upstanding wall, and means for mounting said removable wall ring on said upstanding wall comprising first cooperating peripheral surfaces formed on said wall ring and said wall for holding said wall ring concentric with said wall and second cooperating peripheral surfaces formed on said fluid chamber for holding said ring concentric with said chamber, and cooperating radial surfaces formed on said wall ring and said wall for locating said wall ring axially on said wall, said annular surface and said curved surface on said disk are formed on a removable disk ring, and means for mounting said disk ring on said disk comprising peripheral cooperating surfaces formed on said disk ring and said disk for holding said disk ring concentric with said disk and cooperating radial surfaces formed on said disk ring and said disk for locating said disk ring axially on said disk, each said ring comprising an elastomeric portion molded on a metal portion, said metal portion having said axial and radial surfaces thereon.

20. The centrifugal disk finishing apparatus set forth in claim 16 wherein an elastomeric coating is provided on substantially the entire inner surface of said upstanding wall and substantially the entire inner surface of the disk.

21. The centrifugal disk finishing apparatus set forth in claim 9 wherein said means for supplying fluid to said fluid chamber comprises a source liquid under pressure, said upstanding wall having a liquid outlet adjacent the upper edge thereof, said outlet being positioned below the operating height of the media and parts.

22. The centrifugal disk finishing apparatus set forth in claim 21 including a control circuit for supplying liquid from said source comprising a check valve and an off-on valve for draining the fluid chamber.

23. The centrifugal disk finishing apparatus set forth in claim 22 wherein said means for providing fluid to said chamber comprises means for supplying positive low pressure air to said fluid chamber such that the air cools the gap.

24. In the method of making a centrifugal disk finishing apparatus comprising a finishing chamber, said finishing chamber comprising a stationary upstanding wall, a rotatable disk associated with said upstanding wall, means for mounting said disk for rotation relative to said wall, the improvement comprising forming a fluid chamber beneath said disk, forming the lower edge of the wall with an annular smooth accurately formed surface that extends upwardly and radially inwardly at an angle of about 45° to the axis of the finishing chamber, forming said disk with a peripheral edge having an annular accurately formed surface extending upwardly and radially inwardly at an angle of about 45° to the axis of the finishing chamber, positioning said wall and said disk such that said annular surfaces define a non-contact seal defining a uniform gap for fluid may from said fluid chamber upwardly and inwardly into said finishing chamber, forming said disk such that it is rigid so that the uniformity of the gap is maintained during rotation of the disk, forming said lower edge of said stationary wall with a curved annular upper surface having a radius of about 45° intersecting the annular surface on the lower edge of the upstanding wall, said curved surface merging smoothly with the adjacent portion of the internal surface of the upstanding wall, forming said peripheral edge of said disk with a curved upper surface having a radius of about 45° intersecting the annular surface on the peripheral edge thereof, said curved surface merging smoothly with the adjacent surface of said disk, forming said disk with a transverse inner surface merging with said curved surface on the peripheral edge of said disk, forming said curved surface on said peripheral wall and said curved surface on said disk to define a continuous surface having a radius of about 90° intersected by said gap at an angle of about 45° to the axis of the finishing chamber such that fluid may flow upwardly through the gap to prevent parts, abrasive fluids and the like from passage downwardly through the gap, and mounting said upstanding wall and said disk such that the gap is maintained uniform during operation and when the disk is at rest.

25. The method set forth in claim 24 including forming said annular surface and said curved surface on said stationary wall on a removable wall ring on the upstanding wall, and mounting said removable wall ring on said upstanding wall with first cooperating peripheral surfaces on said wall ring and said wall for holding said wall ring concentric with said wall and second cooperating peripheral surfaces on said fluid chamber for holding said ring concentric with said chamber, and forming cooperating radial surfaces on said wall ring and said wall for locating said wall ring axially on said wall.

26. The method set forth in claim 24 including forming said annular surface and said curved surface on said disk on a removable disk ring, and mounting said disk ring on said disk with peripheral cooperating surfaces for on said disk ring and said disk for holding said disk ring concentric with said disk and forming cooperating radial surfaces on said disk ring and said disk for locating said disk ring axially on said disk.

27. The method set forth in claim 24 including forming a spindle, providing said spindle with cooperating axial surfaces for holding said disk concentric with said spindle, providing a turntable, locating said spindle on said turntable by forming peripheral surfaces for locating said spindle concentric in said turntable and radial surfaces for locating said spindle axially on said turntable, forming peripheral surfaces on said turntable and said fluid chamber for locating the spindle concentric with said fluid chamber, and forming radial surfaces on said turntable and said chamber for locating said turntable axially on said fluid chamber.

28. The method set forth in claim 24 including forming said annular surface and said curved surface on said stationary wall on a removable wall ring on the upstanding wall, and providing first cooperating peripheral surfaces on said wall ring and said wall for holding said wall ring concentric with said wall, and providing second cooperating peripheral surfaces on said fluid chamber for holding said ring concentric with said chamber, and providing cooperating radial surfaces on said wall ring and said wall for locating said wall ring axially on said wall, forming annular surface and said curved surface on said disk on a removable disk ring, forming peripheral cooperating surfaces for on said disk ring and said disk for holding said disk ring concentric with said disk and forming cooperating radial surfaces on said disk ring and said disk for locating said disk ring axially on said disk, forming cooperating axial surfaces for holding said disk concentric with said spindle, forming a turntable, forming peripheral surfaces for locating said spindle concentric in said turntable and forming radial surfaces for locating said spindle axially on said turntable, forming cooperating peripheral surfaces on said turntable and said fluid chamber for locating the spindle concentric with said fluid chamber, forming cooperating radial surfaces on said turntable and said chamber for locating said turntable axially on said fluid chamber.

29. The method set forth in claim 24 including providing an elastomeric layer on at least the annular surfaces and curved surfaces of said upstanding wall and said disk.

30. The method set forth in claim 24 including molding said elastomeric layer to provide an accurate annular surface on said wall and disk.

31. The method set forth in claim 30 including forming said annular surface and said curved surface on said stationary wall on a removable wall ring on the upstanding wall, mounting said removable wall ring on said upstanding wall by providing first cooperating peripheral surfaces on said wall ring and said wall for holding said wall ring concentric with said wall and second cooperating peripheral surfaces on said fluid chamber for holding said ring concentric with said chamber, and providing cooperating radial surfaces on said wall ring and said wall for locating said wall ring axially on said wall, forming said annular surface and said curved surface on said disk on a removable disk ring, and mounting said disk ring on said disk by providing peripheral cooperating surfaces for on said disk ring and said disk for holding said disk ring concentric with said disk and providing cooperating radial surfaces on said disk ring and said disk for locating said disk ring axially on said disk, molding an elastomeric portion on a metal portion of the ring, providing said axial and radial surfaces on said metal portion.

32. The method set forth in claim 29 including providing an elastomeric coating on substantially the entire inner surface of said upstanding wall and substantially the entire inner surface of the disk.

33. The method set forth in claim 24 including supplying liquid fluid to said fluid chamber, and providing liquid outlet on said upstanding wall adjacent the upper edge thereof.

34. The method set forth in claim 33 including providing a control circuit for supplying said liquid providing a check valve and providing an off-on valve for draining the fluid chamber.

35. The method set forth in claim 24 including supplying fluid to said chamber comprises means for supplying positive low pressure air to said fluid chamber such that the air cools the gap.

36. The method set forth in any one of claims 24–35 including providing said curved surfaces on said upstanding wall and said disk such that each extends for about 45°.

37. In the method of making a centrifugal disk finishing apparatus comprising a finishing chamber, said finishing chamber comprising a stationary upstanding wall, a rotatable disk associated with said upstanding wall, means for mounting said disk for rotation relative to said wall, the improvement comprising forming a fluid chamber beneath the disk, forming the lower edge of the wall with an annular smooth accurately formed surface, forming said disk with a peripheral edge having an annular accurately formed surface, positioning said wall and said disk such that said annular surfaces a non-contact seal defining a uniform gap for fluid flow from said fluid chamber into said finishing chamber, forming said disk such that it is rigid so that the uniformity of the gap is maintained during rotation of the disk, forming said lower edge of said stationary wall with a curved annular upper surface intersecting the annular surface on the lower edge of the upstanding wall, said curved surface on said wall merging smoothly with the adjacent portion of the internal surface of the upstanding wall, forming said peripheral edge of said disk with a curved upper surface intersecting the annular surface on the peripheral edge thereof, said curved surface on said disk merging smoothly with the adjacent surface of said disk, forming said disk having a transverse inner surface merging with said curved surface on the peripheral edge of said disk, forming said curved surface on said peripheral wall and said curved surface on said disk forming a continuous surface intersected by said gap such that fluid may flow upwardly through the gap to prevent parts, abrasive fluids and the like from passage downwardly through the gap, mounting said upstanding wall and said disk such that the gap is maintained uniform, providing fluid to said fluid chamber such that fluid flows continuously from said fluid chamber through said gap into said finishing chamber, forming said annular surface and said curved surface on said stationary wall on a removable wall ring on the upstanding wall, and mounting said removable wall ring on the upstanding wall with first cooperating peripheral surfaces on said wall ring and said wall for holding said wall ring concentric with said wall and forming second cooperating peripheral surfaces on said fluid chamber for holding said ring concentric with said chamber, and forming cooperating radial surfaces on said wall ring and said wall for locating said wall ring axially on said wall.

38. The method set forth in claim 37 including forming said annular surface and said curved surface on said disk on a removable disk ring, and mounting said disk ring on said disk with axial cooperating surfaces for on said disk ring and said disk for holding said disk ring concentric with said disk and forming cooperating radial surfaces on said disk ring and said disk for locating said disk ring axially on said disk.

39. The centrifugal disk finishing method set forth in claim 37 including providing a spindle, locating said disk on said spindle with cooperating peripheral surfaces for holding said disk concentric with said spindle, a turntable locating said spindle on said turntable with peripheral surfaces for locating said spindle concentric in said turntable and radial surfaces for locating said spindle axially on said turntable, mounting said turntable on said fluid chamber such that the spindle extends into said fluid chamber by providing cooperating peripheral surfaces on said turntable and said fluid chamber for locating the spindle concentric with said fluid chamber, and providing cooperating radial surfaces on said turntable and said chamber for locating said turntable axially on said fluid chamber.

40. The method set forth in claim 37 including forming said annular surface and said curved surface on said stationary wall on a removable wall ring on the upstanding wall, and mounting said removable wall ring on said upstanding wall with first cooperating peripheral surfaces on said wall ring and said wall for holding said wall ring concentric with said wall and forming second cooperating peripheral surfaces on said fluid chamber for holding said ring concentric with said chamber, and forming cooperating radial surfaces on said wall ring and said wall for locating said wall ring axially on said wall, forming said annular surface and said curved surface on said disk on a removable disk ring, and mounting said disk ring on said disk with peripheral cooperating surfaces for on said disk ring and said disk for holding said disk ring concentric with said disk and forming cooperating radial surfaces on said disk ring and said disk for locating said disk ring axially on said disk, forming a spindle, locating said disk on said spindle with cooperating axial surfaces for holding said disk concentric with said spindle, a turntable locating said spindle on said turntable with peripheral surfaces for locating said spindle concentric in said turntable and with radial surfaces for locating said spindle axially on said turntable, mounting said turntable on said fluid chamber such that the spindle extends into said fluid chamber with cooperating peripheral surfaces on said turntable and said fluid chamber for locating the spindle concentric with said fluid chamber and with cooperating radial surfaces on said turntable and said chamber for locating said turntable axially on said fluid chamber.

41. The method set forth in claim 37 including forming an elastomeric layer on at least the annular surfaces and curved surfaces of said upstanding wall and said disk.

42. The method set forth in claim 41 including molding said elastomeric layer to provide an accurate annular surface on said wall and disk.

43. The method set forth in claim 42 including forming said annular surface and said curved surface on said stationary wall on a removable wall ring on the upstanding wall, and mounting said removable wall ring on said upstanding wall comprising with first cooperating peripheral surfaces on said wall ring and said wall for holding said wall ring concentric with said wall and with second cooperating peripheral surfaces on said fluid chamber for holding said ring concentric with said chamber, and forming cooperating radial surfaces on said wall ring and said wall for locating said wall ring axially on said wall, forming said annular surface and said curved surface on said disk on a removable disk ring, and mounting said disk ring on said disk with cooperating peripheral surfaces for on said disk ring and said disk for holding said disk ring concentric with said disk and with cooperating radial surfaces on said disk ring and said disk for locating said disk ring axially on said disk, forming each said ring with an elastomeric portion molded on a metal portion, forming said metal portion with said axial and radial surfaces thereon.

44. The method set forth in claim 42 including providing an elastomeric coating on substantially the entire inner surface of said upstanding wall and substantially the entire inner surface of the disk.

45. The method set forth in claim 37 including supplying a liquid fluid chamber and forming said upstanding wall with a liquid outlet adjacent the upper edge thereof.

* * * * *